US005295815A

United States Patent [19]

Fraser et al.

[11] Patent Number: 5,295,815

[45] Date of Patent: Mar. 22, 1994

[54] OIL INLET FEED

[75] Inventors: Bruce A. Fraser, Manlius; Timothy V. Nelson, Nedrow; Steven J. Holden, Manlius, all of N.Y.

[73] Assignee: Carrier Corporation, Syracuse, N.Y.

[21] Appl. No.: 85,793

[22] Filed: Jul. 6, 1993

[51] Int. Cl.[5] ..... F01C 21/04; F01C 21/06

[52] U.S. Cl. ..... 418/94; 418/83

[58] Field of Search ..... 418/83, 88, 91, 94; 184/6.23

[56] References Cited

U.S. PATENT DOCUMENTS 4,759,698 7/1988 Nissen ..... 418/88

FOREIGN PATENT DOCUMENTS 0619921 9/1934 Fed. Rep. of Germany ..... 418/94

0106390 5/1988 Japan ..... 418/94

*Primary Examiner*—Richard A. Bertsch

*Assistant Examiner*—Charles G. Freay

[57] ABSTRACT

In a compressor where an oil pump is driven by a crankshaft through a drive tang with oil passing through the drive tang. The bolts holding the drive tang in place tend to agitate the oil and create foam. To prevent foam from being drawn into the oil pump, the agitation is isolated by a sub-chamber defined in part by a spring retainer while oil is supplied via a tube extending through the sub-chamber.

3 Claims, 1 Drawing Sheet

OIL INLET FEED

BACKGROUND OF THE INVENTION

There is an affinity between conventional refrigerants and lubricants such that, in refrigerant compressors, each is normally present in the other. For lubricants specifically, there can be problems associated with refrigerant gas being delivered to the lubrication system. This can be caused by outgassing taking place in the lubricant drawn into the lubrication system as a result of a reduction in pressure. Also, foam produced as a result of agitation of the lubricant by the lubricant pump structure may be drawn into the lubrication system. Specifically, in a semi-hermetic reciprocating compressor having an oil feed to the oil pump passing to the center of the rotating crankshaft, the oil enters through a hole in the drive tang which drives the oil pump rotor. Since the drive tang is bolted on and rotates with the crankshaft, the bolt heads and drive tang agitate the oil/refrigerant mixture producing foam that enters the oil pump. The more foam or gas that enters the oil pump, the less volume left for pumping oil.

SUMMARY OF THE INVENTION

Agitation of the oil by the heads of the bolts holding the oil pump drive tang in place creates a foam which is made up primarily of refrigerant gas. To decrease the amount of foam drawn into the lubrication pump, a spring retainer overlies the heads of the bolts and thereby isolates them from the rest of the oil sump. Also, a tube is used to connect the oil passage in the crankshaft, which feeds the oil pump, to the sump through the isolated section formed by the spring retainer.

It is an object of this invention to decrease the amount of refrigerant gas supplied to the lubrication system.

It is another object of this invention to increase the amount of oil pumped by the oil pump of a compressor. These objects, and others as will become apparent hereinafter, are accomplished by the present invention.

Basically an area of agitation of the lubricant supply is physically separated from the inlet structure of the oil pump whereby the drawing in of foam by the pump is reduced.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
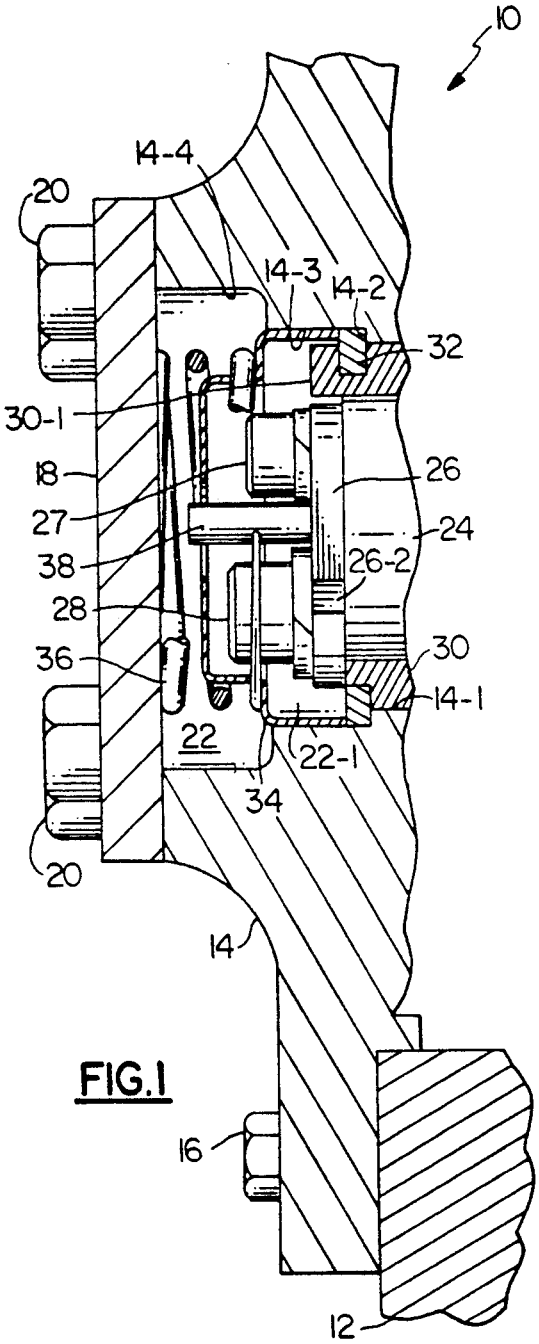
FIG. 1 is a partially sectioned view of the oil supply structure.
Figure 2:
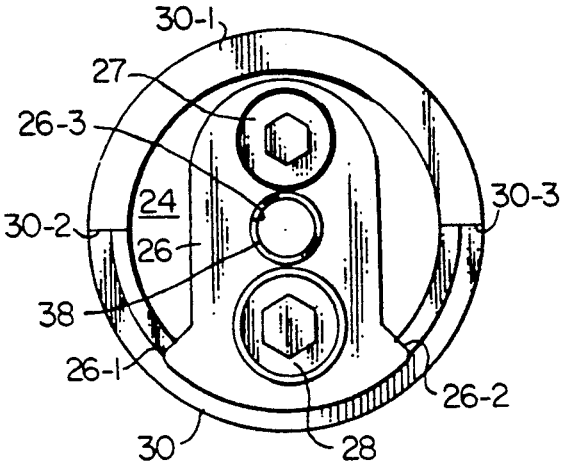
FIG. 2 is an end view of the oil supply structure of FIG. 1.

In FIG. 1 the numeral 10 generally designates a semihermetic reciprocating compressor having a casing 12. Pump housing and bearing member 14 is bolted to casing 12 by bolts 16. Pump housing and bearing member 14 has a first bore 14-1, a second bore 14-3 coacting with bore 14-1 to form a shoulder 14-2, and a third bore 14-4. Cover 18 is bolted to member 14 by bolts 20 and coacts with bores 14-3 and 14-4 to define oil sump 22 which is connected to and fed by oil inlet structure (not illustrated). Crankshaft 24 has a first portion (not illustrated) supported by a bearing (not illustrated) contained in member 14 and an overhung portion. Tang 26 is bolted to the end of the overhung portion of crankshaft 24 by bolts 27 and 28. Tang 26 has a pair of driving surfaces 26-1 and 26-2.

Pump rotor 30 is located in bore 14-1 and surrounds the overhung portion of crankshaft 24. Snap ring 32 is biased against shoulder 14-2 by spring 36 acting upon spring retainer 34 and serves to keep rotor 30 within bore 14-1. This bias force provided by spring 36 against retainer 34 also serves to prevent the retainer 34 from rotating with the other members. Rotor 30 has an axially extending generally semi-circular portion 30-1 which terminates in driven surfaces 30-2 and 30-3 which are engaged by driving surfaces 26-1 and 26-2, respectively, according to the direction of rotation of crankshaft 24.

Inlet tube 38 is located in bore 26-3 of tang 26 and extends axially at least to, and preferably, beyond spring retainer 34. Spring retainer 34 isolates chamber 22-1 from the rest of sump 22. Tang 26, bolts 27 and 28 and portion 30-1 of rotor 30 are located in chamber 22-1. So, when crankshaft 24 is caused to rotate, tang 26 which is bolted thereto rotates therewith as a unit. Depending upon the direction of rotation of crankshaft 24, either driving surface 26-1 engages driven surface 30-2 or driving surface 26-2 engages driven surface 30-3 causing pump rotor 30 to be driven as a unit with crankshaft 24 and tang 26. The rotation of the bolt heads of bolts 27 and 28 in chamber 22-1 causes the generation of foam which tends to be held in chamber 22-1 by spring retainer 34. If tube 38 was not present, the spinning heads of bolts 27 and 28 would surround bore 26-3 such that foam would tend to be drawn into bore 26-3 and fed to the oil pump via axial and radial bores in crankshaft 24. The presence of foam in chamber 22-1 would therefore tend to result in the delivery of a significant amount of refrigerant gas to the lubrication system. Tube 38 extends through chamber 22-1 into sump 22 which is essentially undisturbed by the rotation of bolts 27 and 28 as tang 26 is driven by crankshaft 24. Thus, oil from sump 22 which is essentially free of foam is drawn into tube 38 and fed to the oil pump.

Although a preferred embodiment of the present invention has been illustrated and described, other changes will occur to those skilled in the art. It is therefore intended that the scope of the present invention is to be limited only by the scope of the appended claims.

What is claimed is:

1. In a compressor having an oil pump driven by a crankshaft through a tang, oil supply means comprising:
   - means defining a cavity;
   - means dividing said cavity into an oil sump and a chamber isolated from said oil sump;
   - said tang being located in said chamber and driven by said crankshaft whereby foam is generated in said chamber;
   - tube means for supplying oil to said oil pump and extending from said crankshaft through said chamber to said sump.

2. The oil supply means of claim 1 wherein said means dividing said cavity is a spring retainer which is held in position by spring means located in said oil sump.

3. The oil supply means of claim 2 wherein said tang is secured to said crankshaft by bolts having heads located in said chamber.

* * * * *